US008292632B2

(12) United States Patent
Zhu

(10) Patent No.: US 8,292,632 B2
(45) Date of Patent: Oct. 23, 2012

(54) COMPRESSION CONNECTOR WITH SINK BOARD-MOUNTING STRUCTURE

(75) Inventor: Yu Zhu, shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 24 days.

(21) Appl. No.: 13/070,501

(22) Filed: Mar. 24, 2011

(65) Prior Publication Data

US 2011/0237096 A1 Sep. 29, 2011

(51) Int. Cl.
*H01R 12/00* (2006.01)

(52) U.S. Cl. ..... 439/66; 439/374

(58) Field of Classification Search ..... 439/64, 439/66, 374, 378, 74, 591, 547, 544, 572, 439/571

See application file for complete search history.

(56) References Cited

U.S. PATENT DOCUMENTS

| | | | | |
|---|---|---|---|---|
| 6,758,702 | B2 * | 7/2004 | Johnescu | 439/66 |
| 6,851,986 | B2 | 2/2005 | Zhao | |
| 6,875,027 | B2 * | 4/2005 | Ye et al. | 439/74 |
| 6,984,130 | B2 * | 1/2006 | Richter et al. | 439/66 |
| 7,011,555 | B2 * | 3/2006 | Pan | 439/66 |
| 7,597,581 | B2 * | 10/2009 | Trout et al. | 439/474 |
| 2001/0049206 | A1 * | 12/2001 | Johnescu | 439/66 |
| 2004/0127072 | A1 * | 7/2004 | Matsunaga | 439/66 |
| 2008/0020638 | A1 * | 1/2008 | Polnyi | 439/591 |
| 2008/0220660 | A1 * | 9/2008 | Zhu et al. | 439/709 |

* cited by examiner

*Primary Examiner* — Felix O Figueroa
(74) *Attorney, Agent, or Firm* — Wei Te Chung; Ming Chieh Chang

(57) ABSTRACT

A connector assembly includes a compression connector with a plurality of terminals received therein and a circuit board assembled to the compression connector. The compression connector includes an insulative housing defining a base and a locating portion protruding upwardly from a top surface of the base and, each terminal having a spring portion received in the locating portion and an engaging portion extending forwardly from the spring portion. The circuit board forms a hole receiving the locating portion and makes electrically connection with the engaging portions.

18 Claims, 6 Drawing Sheets

COMPRESSION CONNECTOR WITH SINK BOARD-MOUNTING STRUCTURE

BACKGROUND OF THE INVENTION

1. Field of the Invention

The present invention relates generally to a compression connector, and more particularly to a compression connector with sink board-mounting structure.

2. Description of Related Arts

A compression connector, such as a battery connector, is widely used in electric appliances, such as computers, mobile phones, etc., for providing elastic contact and electrical connection for the same. Correspondingly, a battery connector has already been widely arranged in such electric appliances. A battery connector usually includes an insulative housing and a plurality of contacts received in the insulative housing. The insulative housing usually defines an assembling face attaching to a printed circuit board and a mating face coupling with a battery. The insulative housing defines a plurality of passageways extending through the assembling face and the mating face for receiving the contacts. The contact is equipped with a soldering part, a retaining part which consecutively connects with the soldering part and is retained in the insulative housing, a contact part, and an elastically deformed part coupling between the retaining part and the contact part. When the battery is assembled to the battery connector, the battery meets with the contact parts of the contacts first, and then presses against the contact parts to deform the deformed parts when the battery is pushed deeper. The deformed parts have elasticity and keep the battery in a right and contacted position responding to the elasticity.

As well known to a person skilled in the art, a basic thickness or height is left to the deformed parts for keeping the deformation function of the contact. However, a significant trend in electronic industry is to provide products with smaller and smaller size, which also brings a great many difficulties and challenges to the compression connector design.

Hence, a compression connector with sink board-mounting structure is desired.

SUMMARY OF THE INVENTION

Accordingly, an object of the present invention is to provide an electrical connector with sink board-mounting structure.

To achieve the above object, a connector assembly includes a compression connector with a plurality of terminals received therein and a circuit board assembled to the compression connector. The compression connector includes an insulative housing defining a base and a locating portion protruding upwardly from a top surface of the base and, each terminal having a spring portion received in the locating portion and an engaging portion extending forwardly from the spring portion. The circuit board forms a hole receiving the locating portion and makes electrically connection with the engaging portions.

Other objects, advantages and novel features of the invention will become more apparent from the following detailed description when taken in conjunction with the accompanying drawings.

DETAILED DESCRIPTION OF THE PREFERRED EMBODIMENT

Figure 1:
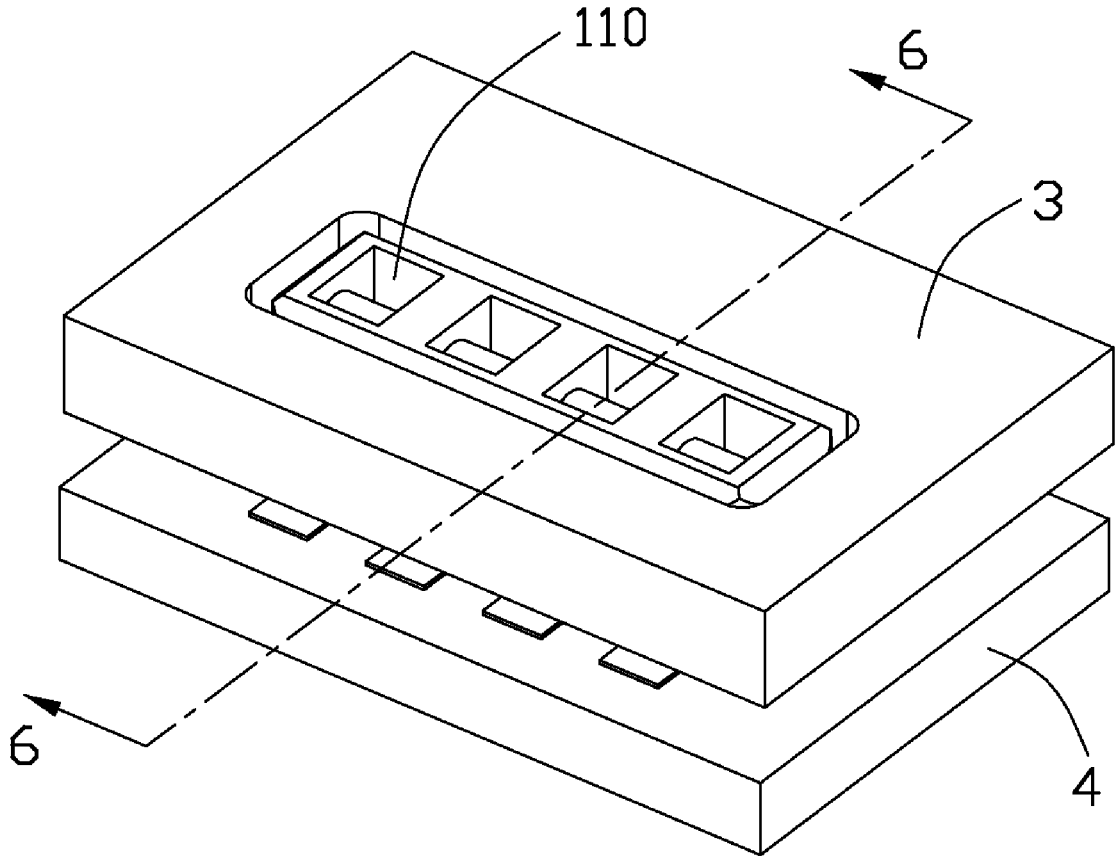
FIG. 1 is a perspective view of a compression connector assembled with circuit boards in accordance with the present invention.
Figure 2:
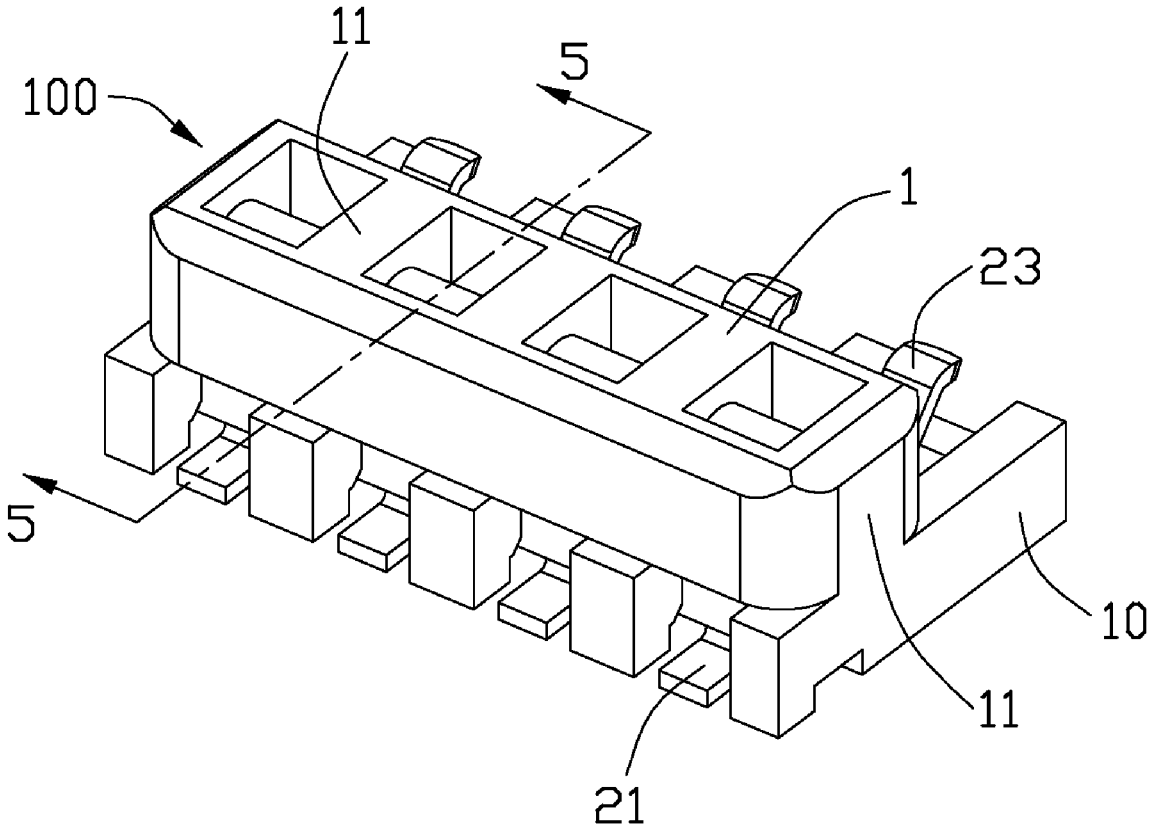
FIG. 2 is a perspective, assembled view of the compression connector.

Referring to FIGS. 1-6, a compression connector 100 of the present invention used for connecting with two parallel circuit boards 3,4, includes an longitudinal insulative housing 1 and a plurality of terminals 2 received parallelly in the insulative housing 1 along a longitudinal direction thereof.

The insulative housing 1 includes a base 10 defining a mounting face 102 on the bottom face and a mating face 101 parallel to the mounting face 102 on the upper face and a locating portion 11 protruding upwardly from the mating face 101. The mounting face 102 is permanently mounted on a second circuit board 4 by soldering and the mating face 101 is intended to confront with and supports a first circuit board 3. The housing defines a row of receiving passageways 103, 110 through the mounting face 102 to receive the terminals and the receiving passageways includes first passageways 103 extending through the mating face 101 and second passageways 110 extending therethrough a top face of the locating portion and connecting with the first passageways 103. The base 10 also has two dislocated posts 104 extending downwardly from the mounting face 102 for positioning the compression connector 100 on the second circuit board 4. The locating portion 11 is located near a rear side of the base 10 and the top face of the locating portion is high than the mating face. The locating portion 11 defines a guiding surface inclined downwardly from a top surface 111 thereof for guiding the first circuit board 3.

Figure 3:
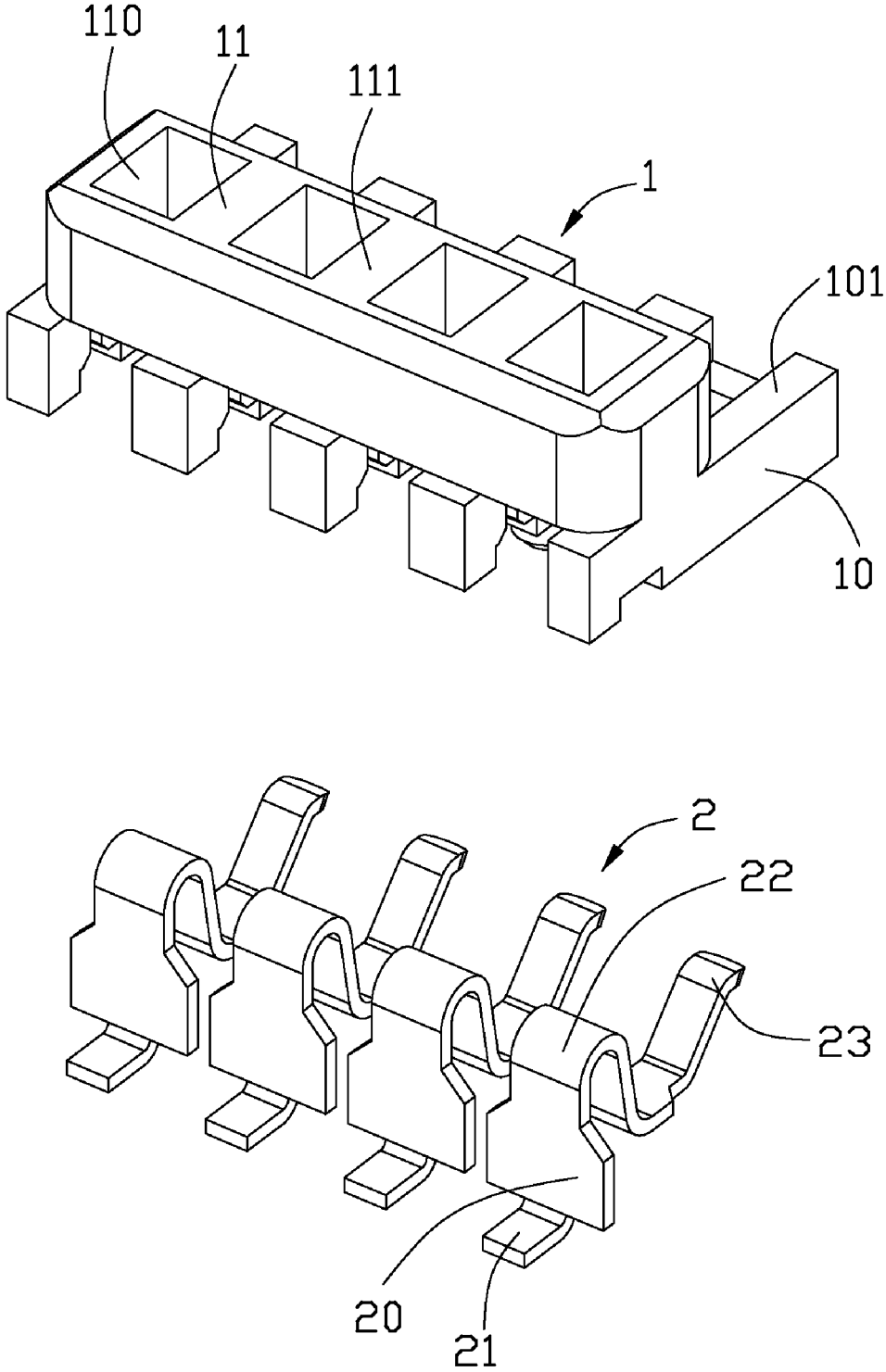
FIG. 3 is a perspective, exploded view of the compression connector.
Figure 4:
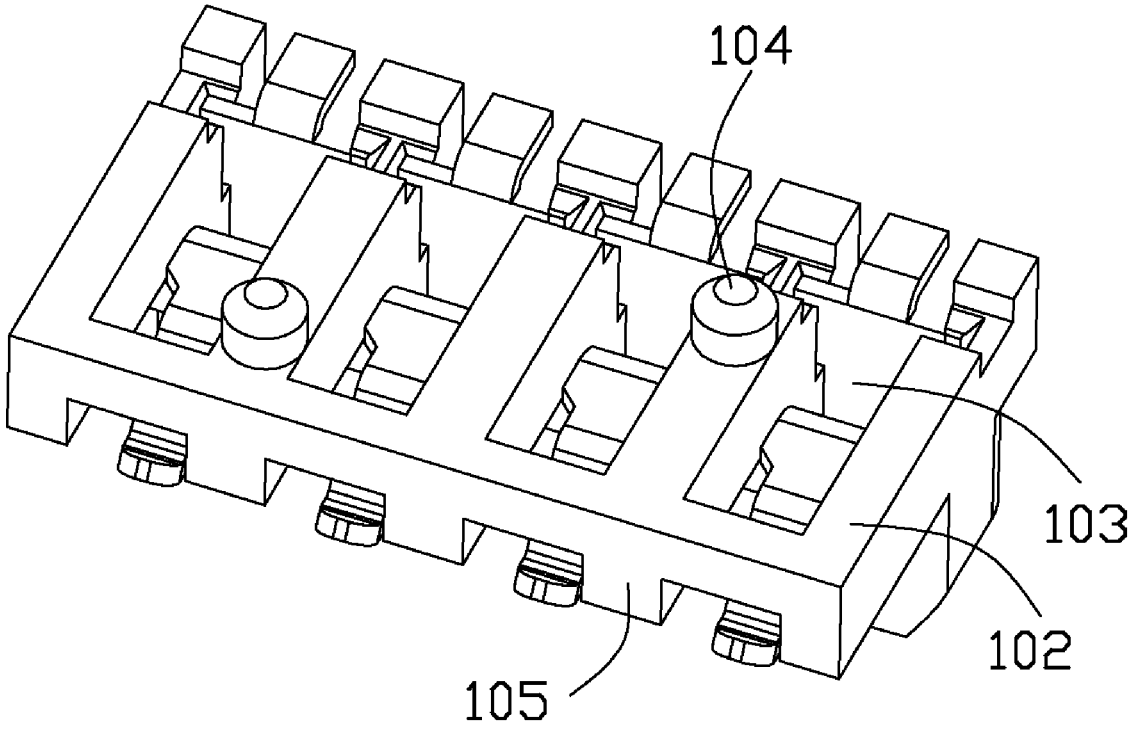
FIG. 4 is another perspective, assembled view of the compression connector of FIG. 2.
Figure 5:
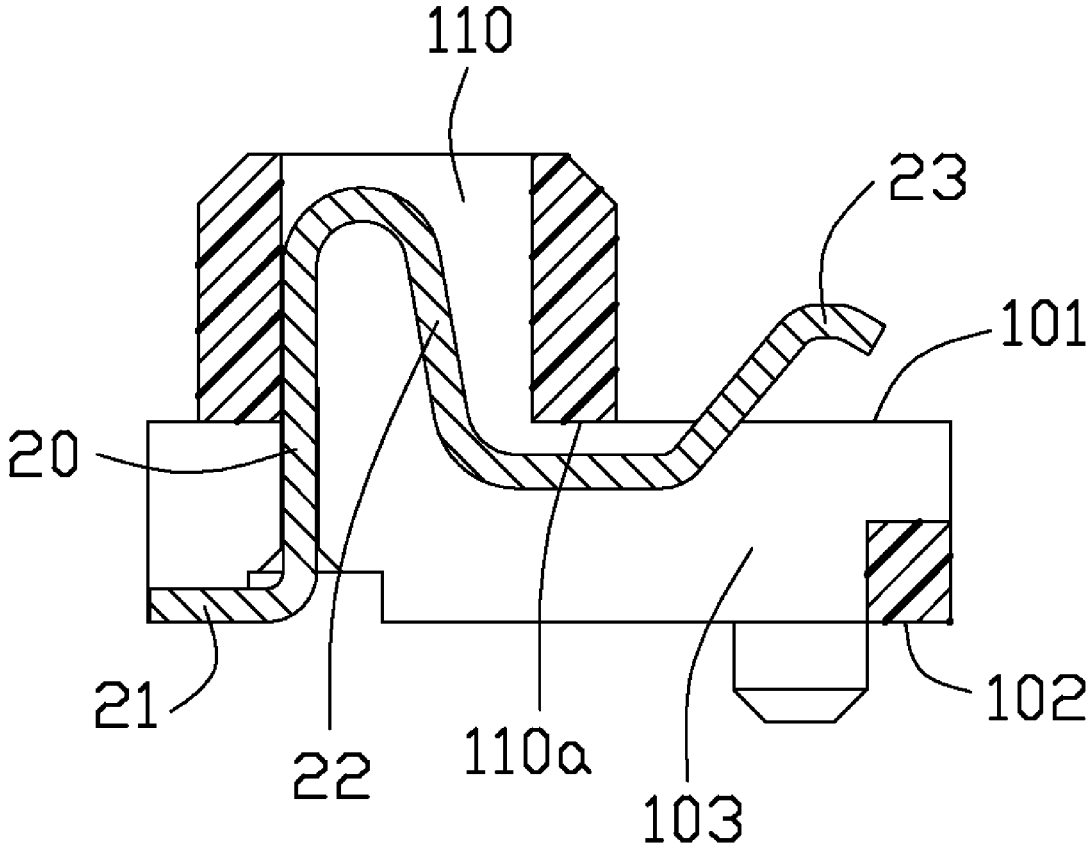
FIG. 5 is a cross section view of the assembly taken along a broken line 5-5 in FIG. 2.

Referring to FIGS. 3&5, The terminals 2 are received in the passageways 103, 110 and each has a retaining portion 20 retained in the inside face of the second passageway, a spring portion 22 extending from the retaining portion 20 and received in the second passageways 110, an engaging portion 23 extending downward and forwardly from the spring portion 22 and a soldering tail 21 extending backwardly from the retaining portion 20. The retaining portion 20 extends vertically in the first passageway 103. The spring portion 22 and the soldering tail 21 respectively extend from opposite ends of the retaining portion 20. The spring portion 22 is an inverted U-shape received in the second passageway. Each engaging portion 23 extends through the first passageway 103 and beyond the mating face 101 of the insulative housing 1. The engaging portion 23 is located in front of the locating portion 11 and lower than the spring portion 22 and the locating portion 11. A segment 221 between the spring portion 22 and the engaging portion 23 does not contact an inner surface 110*a* of the first passageway 103. The soldering tail 21 is soldered on the second circuit board 4.

Figure 6:
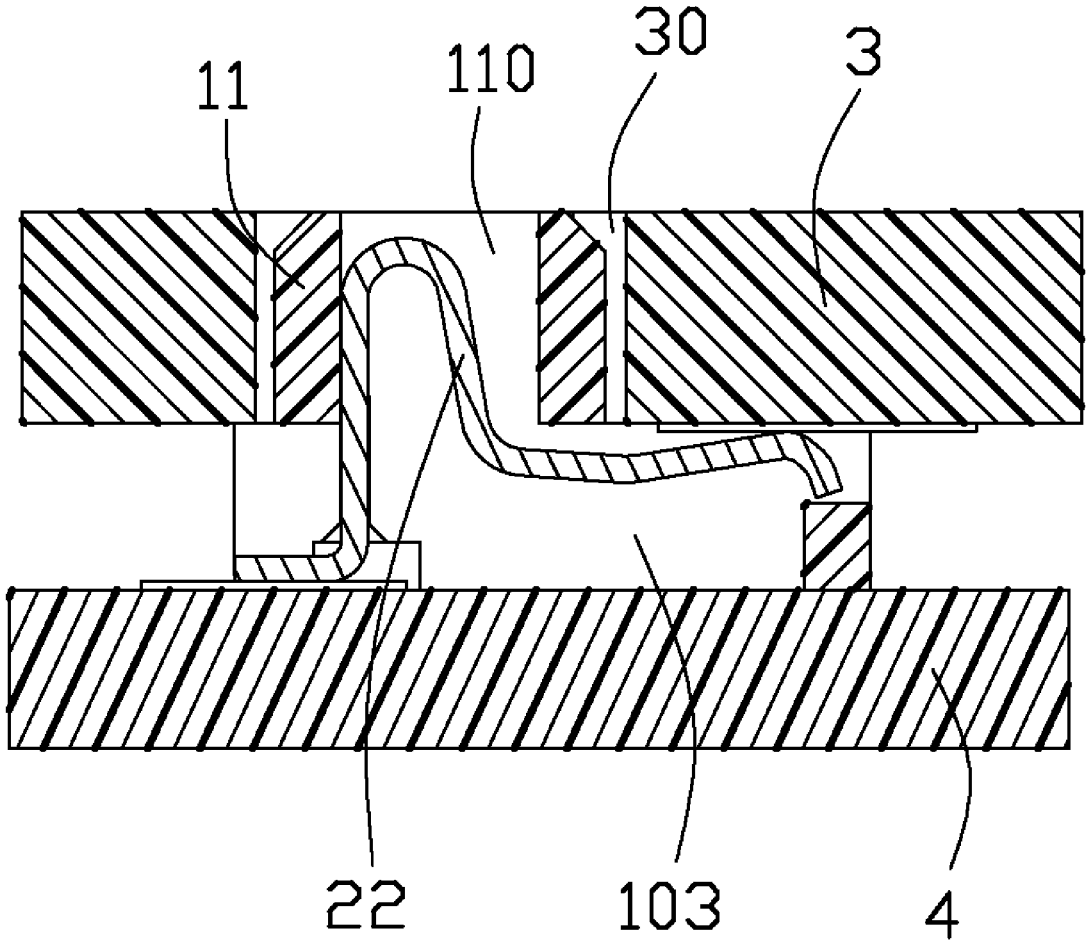
FIG. 6 is a cross section view of the assembly taken along a broken line 6-6 in FIG. 1.

Combination with FIGS. 6 & 1, the first circuit board 3 is assembled to the compression connector 100. The first circuit board 3 has a hole 30 receiving the locating portion 11 and electrically connecting with the engaging portions 23 of the terminals 2. A height of the locating portion 11 is equal to or bigger than a thickness of the first circuit board 3. When the first circuit board 3 is assembled on the compression connector 100, the first circuit board 3 abuts the mating surface 101 of the base 10 and presses the engaging portions 23 of the terminals 2 in the base 10. Alternatively, the second passageways can be not through the passageways.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A compression connector comprising:

an insulative housing including a base defining a mounting face and a mating face parallel to the mounting face and a locating portion protruding upwardly from the mating face, the insulating housing defining a plurality of receiving passageway through the mounting face which include first passageways through the mating face and second passageways disposed in the locating portion and communicating with the first passageways; and a plurality of terminals received in the receiving passageways and each terminal comprising a retaining portion retained in the insulative housing, a spring portion extending from the retaining portion and received in the second passageways, an engaging portion extending from the spring portion and a soldering tail extending from the retaining portion, the engaging portion extending through the first passageway and beyond the mating face of the insulative housing.

2. The compression connector as claimed in claim 1, wherein the spring portion is an inverted U-shape.

3. The compression connector as claimed in claim 2, wherein the engaging portion is lower than the spring portion.

4. The compression connector as claimed in claim 3, wherein the engaging portion is lower than the locating portion.

5. The compression connector as claimed in claim 4, wherein a segment between the spring portion and the engaging portion does not contact an inner surface of the first passageway.

6. The compression connector as claimed in claim 5, wherein the locating portion is located near a rear side of the base and the engaging portion of each terminal is located in front of the locating portion.

7. A compression connector assembly comprising:

a compression connector including an insulative housing defining a base and a locating portion protruding upwardly from a top surface of the base and a plurality of terminals received in the insulative housing, each terminal having a spring portion received in the locating portion and an engaging portion extending forwardly from the spring portion; and a first circuit board assembled to the compression connector and having a hole receiving the locating portion, the circuit board electrically connecting with the engaging portions.

8. The compression connector assembly as claimed in claim 7, wherein the height of the locating portion is equal to or bigger than a thickness of the first circuit board.

9. The compression connector assembly as claimed in claim 7, wherein the first circuit board abuts the top surface of the base and presses the engaging portions of the terminals in the base.

10. The compression connector assembly as claimed in claim 7, wherein the locating portion is located near a rear side of the base and the engaging portion of each terminal is located in front of the locating portion.

11. The compression connector assembly as claimed in claim 7, wherein the spring portion is an inverted U-shape.

12. The compression connector assembly as claimed in claim 7, wherein the engaging portion is lower than the spring portion and the locating portion.

13. The compression connector assembly as claimed in claim 7, wherein a second circuit board parallel to the first circuit board is assembled to a bottom surface of the base.

14. A compression connector for coupling to a mating printed circuit board and a mounting printed circuit board parallel to each other, comprising:

an elongated insulative housing defining a lengthwise direction and a transverse direction perpendicular to each other, and a locating portion unitarily formed on one transverse side portion of the housing and extending in said lengthwise direction for being received in a long hole of the mating printed circuit board;

a plurality of contacts disposed in the housing, each of said contacts defining a spring portion essentially protectively received in the locating portion, a tail section exposed beside said transverse side portion of the housing, and a resilient engaging section upwardly exposed above the other transverse side portion of the housing and beside said locating portion;

wherein said resilient engaging section is adapted to be downwardly deflected toward said other transverse side portion when the mating printed circuit board is coupled to the housing and mechanically and electrically connected to said resilient engaging section.

15. The compression connector as claimed in claim 14, wherein the locating portion defines a plurality of holes in a vertical direction to receive the spring portion therein.

16. The compression connector as claimed in claim 15, wherein said holes extends upwardly through said locating portion.

17. The compression connector as claimed in claim 14, wherein the spring portion is higher than the resilient engaging section, and the resilient engaging section is higher than the tail section.

18. The compression connector as claimed in claim 14, wherein the other transverse side portion provides an upward abutment surface which is adapted to abut against an underside of the mating printed circuit board when said mating printed circuit board is coupled to the housing.

* * * * *